US005613240A

United States Patent [19]

Lewis et al.

[11] Patent Number: 5,613,240

[45] Date of Patent: Mar. 18, 1997

[54] METHOD OF PREPARING SODALITE FROM CHLORIDE SALT OCCLUDED ZEOLITE

[75] Inventors: Michele A. Lewis, Naperville; Candido Pereira, Lisle, both of Ill.

[73] Assignee: The United States of America as represented by the United States Department of Energy, Washington, D.C.

[21] Appl. No.: 375,141

[22] Filed: Jan. 19, 1995

[51] Int. Cl.[6] ..... G21F 9/00

[52] U.S. Cl. ..... 588/11; 588/12; 588/14; 976/DIG. 385

[58] Field of Search ..... 588/11, 12, 14; 501/155, 152; 264/0.5; 976/DIG. 385

[56] References Cited

U.S. PATENT DOCUMENTS

| | | | |
|---|---|---|---|
| 3,262,885 | 7/1966 | Rushbrook | 588/14 |
| 4,172,807 | 10/1979 | Larker | 588/11 |
| 4,376,792 | 3/1983 | Angelini et al. | 427/6 |

OTHER PUBLICATIONS

Plodinec, M. J., Improved Glass Compositions For Immobilization of SRP Waste, Proceedings of the International Symposium on the Scientific Basis for Nuclear Waste Management, Nov. 27–30, 1979, pp. 223–229.

*Primary Examiner*—Ngoclan Mai

*Attorney, Agent, or Firm*—Hugh Glenn; Robert J. Fisher; William R. Moser

[57] ABSTRACT

A method for immobilizing waste chloride salts containing radionuclides and hazardous nuclear material for permanent disposal starting with a substantially dry zeolite and sufficient glass to form leach resistant sodalite with occluded radionuclides and hazardous nuclear material. The zeolite and glass are heated to a temperature up to about 1000° K. to convert the zeolite to sodalite and thereafter maintained at a pressure and temperature sufficient to form a sodalite product near theoretical density. Pressure is used on the formed sodalite to produce the required density.

17 Claims, No Drawings

METHOD OF PREPARING SODALITE FROM CHLORIDE SALT OCCLUDED ZEOLITE

CONTRACTUAL ORIGIN OF THE INVENTION

The United States Government has rights in this invention pursuant to Contract No. W-31-109-ENG-38 between the U.S. Department of Energy and The University of Chicago representing Argonne National Laboratory.

BACKGROUND OF THE INVENTION

This invention relates to a method for immobilizing radioactive wastes for permanent disposal. More particularly, the invention relates to a method of immobilizing mixed waste chloride salts containing radionuclides and other hazardous materials for permanent disposal.

The recovery of fissionable materials such as uranium and plutonium from spent nuclear reactor fuels can be carried out by an electrorefining method using electrochemical cells of the type described in U.S. Pat. Nos. 4,596,647 and 2,951,793, as well as U.S. Pat. No. 4,880,506. It is the electrorefining method which is being developed for the reprocessing of spent nuclear fuel. In a typical electrorefining cell, an electrolyte consisting of a molten eutectic salt mixture such as KCl and LiCl is used to transport the metal or metals to be purified between electrode solutions. When used to reprocess spent nuclear reactor fuels, the salt mixture becomes contaminated with radionuclides, such as cesium$^{-137}$ and strontium$^{-90}$, hazardous metals such as barium and other species such as sodium and iodine$^{-129}$ and eventually is no longer suitable for use in the electrorefining cell.

Ideally the salt would be decontaminated by removing the heat producing radionuclides, primarily cesium and strontium, and any other metals, e.g. sodium, which could potentially interfere in the operation of the electrorefiner and the purified salt would be recycled back to the electrorefiner. However, the separation of cesium and strontium chloride from the salt is difficult, and since they are large heat producers it would be necessary to dilute them in another matrix material and/or cool them before they could be stored. It is therefore more practical to dispose of the cesium and strontium and any other radionuclides and toxic metal chlorides and iodides along with a portion of the salt matrix. The waste salt containing the cesium and strontium is a high level waste (HLW), and as such must be disposed of in the geologic repository for HLW. This requires that the waste form be leach resistant to prevent an uncontrolled release of the radionuclides and other hazardous chemicals such as barium into the groundwater. Since waste salts are chlorides and are very water soluble, a method for encapsulating and immobilizing the waste salt must be identified.

One problem with developing a waste storage medium is that the waste salt consists primarily of chloride salts of the alkali metals and as such is not readily amenable to treatment using procedures and techniques developed for immobilizing the cesium and strontium in other nuclear waste streams. For instance, it has been taught that the chloride salts cannot be added directly to glass-forming compounds and processed to yield a leach-resistant glass since glasses containing halide ions are relatively water soluble, see U.S. Statutory Invention Registration H1,227, published Sep. 7, 1993. Therefore, it was thought that for immobilization in a glass matrix the waste chloride salts must be converted into oxides or other chemical forms compatible with the glass-making process.

However, conversion processes are expensive and time-consuming and raise environmental concerns about the off-gases produced by the processes. A mortar matrix has also been considered as a possible waste form for the waste chloride salt. A special mortar was developed to incorporate lithium, potassium, cesium and strontium chloride salts into its structure and thereby immobilize them. However, when irradiated, the water in the mortar was radiolyzed and large quantities of hydrogen gas were generated.

A new matrix for immobilizing waste chloride salts was therefore needed, and Invention Disclosure H1,227 addressed this problem by disclosing special zeolites which can be treated with molten salts. When some zeolites are treated with molten salts, salt molecules penetrate the cavities and channels of the zeolite and are then said to be occluded. Occluded molecules provide a transfer medium for ion exchange between the cations in the zeolite and those in the bulk salt. A zeolite which has a high selectivity for cesium, strontium and barium would be a promising candidate for an immobilization matrix.

U.S. Pat. No. 5,340,506 which issued Aug. 23, 1994 also addressed the problem by chemically reacting mixtures of NaOH, $Al_2O_3$, $SiO_2$ to form a sodalite intermediate. Further processing produced a sodalite product with radionuclides and hazardous material contained in the sodalite.

As stated in the '506 patent, an advantage of the process of invention registration H1,227 was in the use of certain zeolites to occlude and immobilize waste radioactive chloride salt. Contact between the zeolite (for example zeolite A or mixtures of chabazite and erionite-type zeolites or mixtures thereof) in the sodium, potassium or lithium form and the molten salt resulted in ion exchange between the radionuclides cesium and strontium and the hazardous material barium in the salt and the sodium, potassium, lithium in the zeolite and the occlusion of up to about 25% by weight of the salt within the molecular cavities of the zeolite.

One of the problems inherent in the method disclosed in invention registration H1,227 is that the resultant material is not suitable for storage as a long term waste because it is not a monolithic solid.

Although the use of synthetic naturally occurring minerals to store radioactive ions have been studied, as for instance in U.S. Pat. No. 4,808,318, which describes the use of a modified phlogopite to recover cesium ions from waste solutions and the advances that were set forth in the aforementioned '506 patent there is still needed a method of immobilizing mixtures of salts, particularly chloride salts containing radionuclides and other hazardous wastes so that the highly soluble salts can be safely stored for long periods of time in HLW stored facilities without presenting a hazard to the environment.

SUMMARY OF THE INVENTION

A method has been found by which, contrary to the teachings of the prior art, waste chloride salts containing radionuclides and other hazardous wastes can be incorporated into zeolite and combined with glass to form a leach resistant material suitable for long term storage, having a near theoretical density, resulting in a lower volume of waste material for storage than heretofore available.

The method of the invention for immobilizing waste chloride salts containing radionuclides and hazardous nuclide material for permanent disposal comprises providing a substantially dry zeolite and sufficient glass to form leach resistant sodalite with occluded radionuclides and hazardous material, heating the zeolite and glass to a temperature up to about 1000° K. to convert the zeolite to sodalite and thereafter maintaining the sodalite at a pressure and temperature sufficient to form a sodalite product near theoretical density.

It is therefore an object of the invention to provide an effective method for disposing of waste chloride salt.

It is another object of the invention to provide an improved method for stabilizing waste chloride salts containing radionuclides and other hazardous waste material.

It is still another object of the invention to provide an improved method for stabilizing waste chloride salts containing radionuclides and other hazardous waste materials so that they may be safely placed in high level waste facilities for long periods of time without fear of damage to the environment.

It is still another object of the invention to provide an improved matrix material for storing waste chloride salts containing radionuclides such as cesium and strontium and other hazardous waste such as barium so that they may be safely stored for long periods of time without causing damage to the environment by leaching from the matrix when contacted with water.

DETAILED DESCRIPTION OF THE INVENTION

The invention is based upon the discovery that sodalite can be produced from salt occluded zeolites by the use of heat or heat and pressure in the presence of glass contrary to prior teachings in the art. More specifically, it has been found that providing glass in the amount of about 5% to about 10% by weight and the presence of salt occluded zeolite while heating the material to a temperature of about 1000° K. produces a material which, when tested by x-ray diffraction techniques, is sodalite. Because sodalite will absorb less waste salt than a corresponding amount of zeolite, it is required for the full appreciation of the method to provide excess amount of zeolite in the mixture prior to heating to accommodate the diminished capacity of sodalite to absorb the radionuclides. This prevents the resultant product from leaving a large amount of radioactive material not occluded by the sodalite.

More specifically, zeolite in powder or pellet form may be initially dried by heating in a series of four steps to 800° K. and flowing nitrogen or under a vacuum. This process removed nearly all the water from the zeolite and the zeolite was thereafter stored in an inert atmosphere such as in a glove box. In the protective atmosphere or in a glove box, the dry zeolite powder or pellets was loaded into a quartz test tube. The simulated waste salt was loaded into another quartz tube. The waste salt may be comprised of the following:

| | |
|---|---|
| KI | 0.3% |
| $NdCl_3$ | 1.04% |
| $LaCl_3$ | 1.06% |
| $CeCl_3$ | 0.74% |
| $YCl_3$ | 0.13% |
| LiCl | 32.9% |
| NaCl | 5.97% |
| $SrCl_2$ | 0.59% |
| $BaCl_2$ | 1.43% |
| KCl | 44.83% |
| CsCl | 3.73% |

After the salt and zeolite are heated to about 700° K. the salt is poured into the tube containing the zeolite and allowed to stand for 24 hours. In an ion exchange process, sufficient product chlorides are concentrated in the zeolite relative to the remainder of the salt. After the ion exchange, most of the excess salt is removed from the zeolite surface even though some of the free salt remains present.

Thereafter, the salt loaded zeolite is combined with additional (up to 2 times) dehydrated zeolite in an alumina crucible. Because sodalite can occlude approximately ⅓ the volume of salt that a zeolite can occlude, generally twice the amount of occluded zeolite is added. In any event, enough dehydrated zeolite is added to reduce the total salt level to about 12wt % or less. Glass is added to this mixture in the range of between about 5% by weight to about 10% by weight of the zeolite and salt.

Two hot pressing processes have been developed. In the one process, the zeolite powders/pellets are first converted to sodalite powders/pellets by heating to 1000° K. for 24 hours or so. The sodalite powders/pellets are then densified using hot pressing at temperatures around 1200° K. and 20–28 MPa. In a high pressure process, the zeolite powders and salt mixture is converted to sodalite directly during hot pressing at a temperature of 1000° K. and pressures around 120 MPa.

In a low pressure process, prior to hot pressing the zeolite and salt mixture is coverted to sodalite. If the glass is in frit form, the mixture is stirred and heated to 1000° K. and held at that temperature for about 25 hours. After cooling, x-ray diffraction shows only sodalite.

The sodalite powder with the occluded radionuclides is added to a graphite die and is initially cold pressed at 40 MPa. The cold pressed material is then heated to 1200 K. using a 20 K. per minute ramp rate and held at 28 MPa for approximately 30 minutes at maximum temperature. It is believed that a minimum pressure of 20 MPa will suffice. The measured gross pellet densities were between 2.1 and 2.4 grams per cubic centimeters (cc). Theoretical density of chlorosodalite is 2.31 grams per cc.

In some cases, the salt loaded zeolite pellets were ground prior to conversion to the sodalite. When pellets were converted directly to sodalite, the preferred glass was aluminum 0.35 wt. %, calcium 13.1 wt %, sodium 7.6 wt %, magnesium 0.3 wt %, silicon 20.2 wt %, strontium 0.1 wt %, boron 6.7 wt %, potassium 0.06 wt %, zirconium 0.1 wt % with the balance oxygen. This glass was the only glass tested which provided full conversion of the zeolite pellets to sodalite. However, when the pellets were ground, a variety of glasses were useful to convert all of the zeolite to sodalite. Other glasses useful had the following compositions.

| | Best | Others | | Worst |
|---|---|---|---|---|
| Al | 0.35% | 5.1 | 3.3 | 4.0 |
| Ca | 13.1% | 9.61 | 7.9 | 0.37 |
| Na | 7.6% | 4.9 | 2.4 | 4.1 |
| Mg | 0.3% | 0.26 | 0.2 | 0.03 |
| Si | 22.2% | 25.7 | 28.2 | 23 |
| Sr | 0.1% | 0.06 | 6.8 | 0.8 |
| B | 6.7% | 4.3 | 3.0 | 3.7 |
| K | 0.06% | 0.66 | 1.0 | 0.17 |
| Zr | 0.06% | balance O2 | Ba 0.1 | 19.8 |
| Balance $O_2$ | | | $Zr_x$ 0.35 | |

Another method of preparing the salt occluded sodalite is to dehydrate zeolite as stated above and to combine the dehydrated zeolite with a simulated waste salt of up to about 12% by weight or less and about 5 to about 10 weight % by glass. These materials were combined into a crucible and stirred for a short period of time on the order of less than one minute or about 10–30 seconds and then heated to about 1000° K. and held at that temperature for about 24 hours. After cooling, x-ray diffraction showed only features consistent with sodalite. In order to produce sodalite of near theoretical density which is important for leach testing, the material has to be hot pressed as previously described.

When zeolite is heated without the presence of glass, a mixture of nepheline and salt results and sodalite is not a major product. Nepheline has poor leach resistance and is not satisfactory for storing radioactive materials. However, when glass is added as described, then sodalite is the major product and is a significant improvement in leach testing compared to nepheline. Table 1 shows a comparison of normalized release rates for sodalite and nepheline using a salt such as that described above as a substitute for the radioactive chloride salt generally produced in the IFR process.

TABLE 1

| | Normalized Release Rates ($g/m^2day$)) | |
|---|---|---|
| Element | Sodalite | Nepheline |
| Cs | 1.2 | 132 |
| Sr | 0.01 | 3.3 |
| Ba | 0.01 | 25 |
| Na | 0.4 | 6 |
| K | 0.6 | 9.4 |
| Li | 2.3 | 6.7 |

In a high pressure process, the mixture of salt occluded zeolite, additional zeolite and glass is added to a graphite die and is initially cold pressed to 40 MPa. The cold pressed material is then heated to 1000° K. with a ramp rate of 20 K. per minute. After the temperature is at least 700° K., a pressure of about 120 MPa is applied. The pressure is maintained at 1000° K. until densification is complete. The typical length of time required for a sample about 2.5 cm in diameter and about 0.3 cm thick is less than 30 minutes.

In a twenty-eight day leach test, the sodalite prepared from and in accordance with the high pressure process set forth above provided the result set forth in Table 2.

TABLE 2

| Element | Normalized Release Rate 28 Day 90° C. Test |
|---|---|
| Al | 0.16 |
| Ba | 0.88 |
| B | 1.26 |
| Ca | 0.85 |
| Cs | 0.58 |
| K | 1.0 |
| Li | 0.83 |
| Na | 0.58 |
| Si | 0.23 |
| Sr | 1.22 |
| Ce | 0.013 |
| Nd | 0.009 |
| La | 0.009 |
| Y | ~0 |

Both Table 1 and Table 2 show results with deionized water maintained at 90° C.

It is preferred that a borosilicate glass is used and that it is present as glass frit. Moreover, while zeolites in general may be useful, the preferred zeolite is zeolite A and zeolite X otherwise known as faujasite. Mixtures of zeolite A and zeolite X are also useful.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. A method for immobilizing waste chloride salts containing radionuclides and hazardous nuclear material for permanent disposal comprising providing a substantially dry zeolite, the waste chloride salts, and sufficient glass to form leach resistant sodalite with occluded radionuclides and hazardous nuclear material; heating the zeolite, the waste chloride salts, and glass to a temperature up to about 1000° K. to convert the zeolite to sodalite; and thereafter maintaining the sodalite at a pressure and temperature sufficient to form a sodalite product near theoretical density.

2. The method of claim 1, wherein the zeolite is zeolite A or zeolite X or mixtures thereof and is saturated with radionuclides prior to conversion to sodalite.

3. The method of claim 2, wherein the glass is present in an amount of not less than about 5% by weight and sufficient unsaturated zeolite is present to result in occlusion of substantially all the radionuclides by the sodalite produced therefrom.

4. The method of claim 2, wherein the glass is a borosilicate glass present in the range of from about 5% to about 10% by weight of the zeolite.

5. The method of claim 1, wherein the waste chloride salt is principally a mixture of KCl and LiCl with radionuclides including the chlorides of La, Nd, Ce, Y, Sr, Cs, and Ba.

6. The method of claim 1, wherein the glass is initially present as glass frit.

7. The method of claim 1, wherein the sodalite is hot pressed at an elevated temperature of about 1200° K. under pressure of about 20 MPa.

8. The method of claim 1, wherein the sodalite is cold pressed at about 40 MPa and thereafter heated to about 1200° K. at 28 MPa.

9. A method of immobilizing waste chloride salts containing radionuclides and hazardous nuclear material for permanent disposal comprising providing a mixture of substantially dry zeolite and radionuclide salt-occluded zeolite and glass, heating said mixture to a temperature effective to produce sodalite.

10. The method of claim 9, wherein the zeolite is in pellet or powder form.

11. The method of claim 9, wherein the glass is a borosilicate glass.

12. The method of claim 9, wherein the mixture is heated to a temperature of about 1000° K. to effect production of sodalite.

13. The method of claim 12, wherein glass is present in an amount of least 5% by weight.

14. The method of claim 12, wherein glass is present in an amount of up to about 10% by weight.

15. The method of claim 9, wherein the zeolite is zeolite A or zeolite X or mixtures thereof.

16. The method of claim 9, wherein the zeolite includes a portion saturated with radionuclides and a portion substantially free of radionuclides to provide upon heating in the presence of glass frit sufficient sodalite to occlude substantially all of the radionuclides.

17. The method of claim 16, wherein the sodalite is subjected to heat and pressure for a time sufficient to densify the sodalite to near theoretical density.

* * * * *